US006845810B2

(12) United States Patent
Siak et al.

(10) Patent No.: US 6,845,810 B2
(45) Date of Patent: Jan. 25, 2005

(54) LOST-FOAM CASTING APPARATUS FOR IMPROVED RECYCLING OF SPRUE-METAL

(75) Inventors: June-Sang Siak, Troy, MI (US); Gordon Alwin Tooley, Saginaw, MI (US); Mark Eugene Hoover, Mt. Morris, MI (US); Jerry Allen Barendreght, Leonard, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/269,659

(22) Filed: Oct. 11, 2002

(65) Prior Publication Data

US 2004/0069438 A1 Apr. 15, 2004

(51) Int. Cl.[7] ..... B22D 7/00
(52) U.S. Cl. ..... 164/244; 164/349
(58) Field of Search ..... 164/344, 349, 164/244, 133, 134

(56) References Cited

U.S. PATENT DOCUMENTS 4,240,493 A * 12/1980 Wilmarth ..... 164/35
4,452,296 A * 6/1984 Amano et al. ..... 164/363
4,802,527 A * 2/1989 Brockmeyer et al. ..... 164/358
5,263,533 A * 11/1993 Druschitz et al. ..... 164/363
5,425,410 A * 6/1995 Reynolds ..... 164/358
6,189,598 B1 * 2/2001 Chandley et al. ..... 164/34
6,619,373 B1 * 9/2003 Tooley et al. ..... 164/363

OTHER PUBLICATIONS

U.S. Appl. No. 10/132,878, filed Apr. 25, 2002 "Lost Foam Casting Apparatus for Reducing Porosity and Inclusions in Metal Castings".

* cited by examiner

*Primary Examiner*—Kiley S. Stoner
*Assistant Examiner*—Len Tran
(74) *Attorney, Agent, or Firm*—Kathryn A. Marra

(57) ABSTRACT

Apparatus for the gravity-cast, "lost-foam" casting of metal castings, including a fugitive, pyrolizable foam pattern forming a casting cavity in a bed of loose sand, and a hollow sprue for supplying melt to the casting cavity, wherein the sprue consists essentially of the same metal as is being cast. A high-temperature, porous vent is provided adjacent the discharge end of the metal sprue to expel air from the sprue that would otherwise be trapped therein.

11 Claims, 5 Drawing Sheets

LOST-FOAM CASTING APPARATUS FOR IMPROVED RECYCLING OF SPRUE-METAL

TECHNICAL FIELD

This invention relates to apparatus for the gravity-cast, bottom-filled, "lost-foam" casting of metal, and more particularly to readily recyclable sprues therefor.

BACKGROUND OF THE INVENTION

The so-called "lost-foam" casting process is a well known method for producing metal castings wherein a fugitive, pyrolizable, polymeric, foam pattern is covered with a thin, gas-permeable, ceramic coating, and embedded in an unbonded sand mold to form a mold cavity within the sand. Molten metal (e.g. iron or aluminum inter alia) is then introduced into the mold to pyrolize, and displace the pattern with molten metal. Gaseous and liquid pyrolysis products escape through the gas-permeable, ceramic coating into the interstices between the unbonded sand particles. Typical fugitive polymeric foam patterns comprise expanded polystyrene foam (EPS), polymethylmethacrylate (PMMA), and certain copolymers. The molten metal may be either gravity-cast (i.e. melt is poured from an overhead ladle or furnace), or countergravity-cast (i.e. melt is forced, e.g. by vacuum or low pressure, upwardly into the mold from an underlying vessel).

In gravity-cast lost-foam processes, the hydraulic head of the melt is the driving force for filling the mold cavity with melt. Gravity-cast lost-foam processes are known that (1) top-fill the mold cavity by pouring the melt into a basin overlying the pattern so that the melt enters the mold cavity through a gating system comprising one or more gates located above the pattern, or (2) bottom-fill the mold cavity by pouring the melt into a vertical sprue that lies adjacent the pattern and extends from above the mold cavity to the bottom of the mold cavity for filling the mold cavity from beneath through a gating system having one or more gates located beneath the pattern. Heretofore, the sprues have been formed (1) from porous-ceramic-coated fugitive foams like that used for the patterns, or (2) from porous ceramic shells like those described in copending US Patent application U.S. Ser. No. 10/132,878 filed Apr. 25, 2002, and assigned to the assignee of the present invention. After cooling, the metal left in the sprue (hereafter "sprue-metal") and gating system are cut from the casting and recycled. In either case, the sprue-metal is covered with a layer of ceramic that must be removed from the sprue-metal before the sprue-metal can be remelted and reused.

SUMMARY OF THE INVENTION

The present invention eliminates the need to have to remove a ceramic layer from the surface of gravity-cast, lost-foam sprue-metal before reusing the sprue-metal. The present invention involves apparatus for the gravity, bottom-fill, lost-foam, casting of molten metal into a desired shape which apparatus comprises: (1) a bed of loose sand forming a mold having a molding cavity therein that conforms to the shape of the casting; (2) a flask containing the bed of sand; (3) a pyrolizable, fugitive, polymeric pattern embedded in the sand and shaping the molding cavity; (4) a fugitive body attached to the pattern and forming a gating system in the sand for supplying molten metal to the molding cavity, (5) an inlet to the gating system for admitting molten metal into the gating system; and (6) a hollow sprue embedded in the sand for supplying molten metal to the inlet. In accordance with the present invention, sprue consists essentially of the metal being cast so that the sprue-metal can be recycled at the end of pouring without first having to remove a ceramic outer layer therefrom. Preferably, the metal being cast and the metal that comprises the sprue will contain the same alloyants in about the same concentrations. Most preferably, the metal being cast and the metal that comprises the sprue will contain the same alloyants, but in sufficiently different concentrations that the metal that comprises the sprue has a higher melting point than the pouring temperature of the metal being cast to retard melting of the sprue during pouring of the molten metal.

According to a most preferred embodiment, the sprue includes a vent adjacent its outlet end for venting air that would otherwise be trapped in the sprue during pouring of the molten metal. The vent will preferably comprise a high temperature, porous material (e.g. ceramic or metal). The vent material may take the form of one or more porous plugs in an aperture(s) through the sidewall of the sprue, one or more porous patches covering such aperture(s), a porous sleeve surrounding/covering such aperture(s), or a porous sleeve-coupling/collar that joins the outlet/discharge end of the metal sprue to the inlet to the gating system.

BRIEF DESCRIPTION OF THE DRAWINGS

The invention will be better understood when considered in the light of the following detailed description of certain specific embodiments thereof which is provide hereafter in conjunction with the several figures in which.

DESCRIPTION OF THE INVENTION

Figure 1:
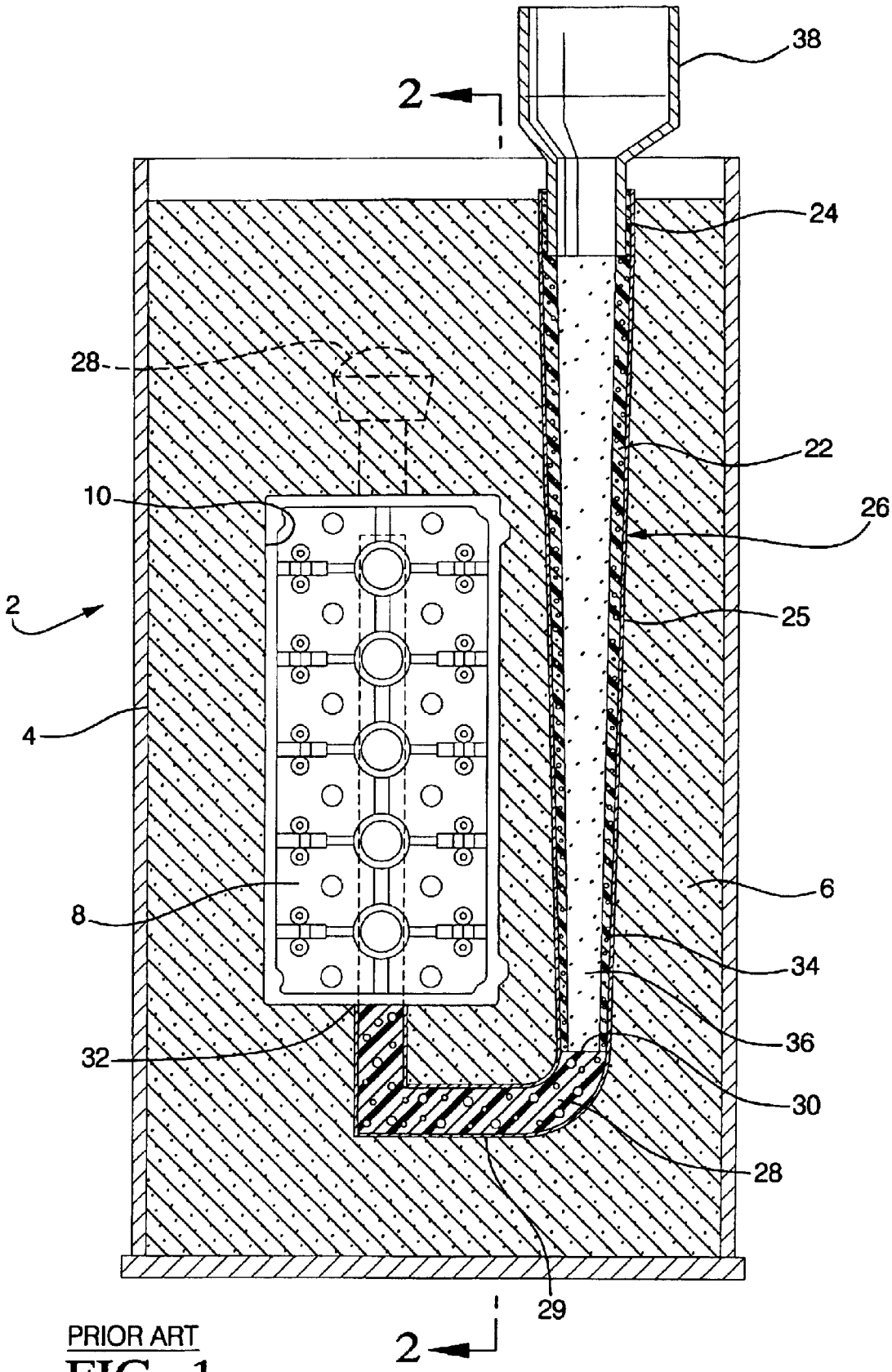
PRIOR ART FIG. 1
FIG. 1 is a partially-sectioned, side view of a sand-filled, lost-foam casting flask having a pattern, and prior art sprue therefor, embedded therein.
Figure 2:
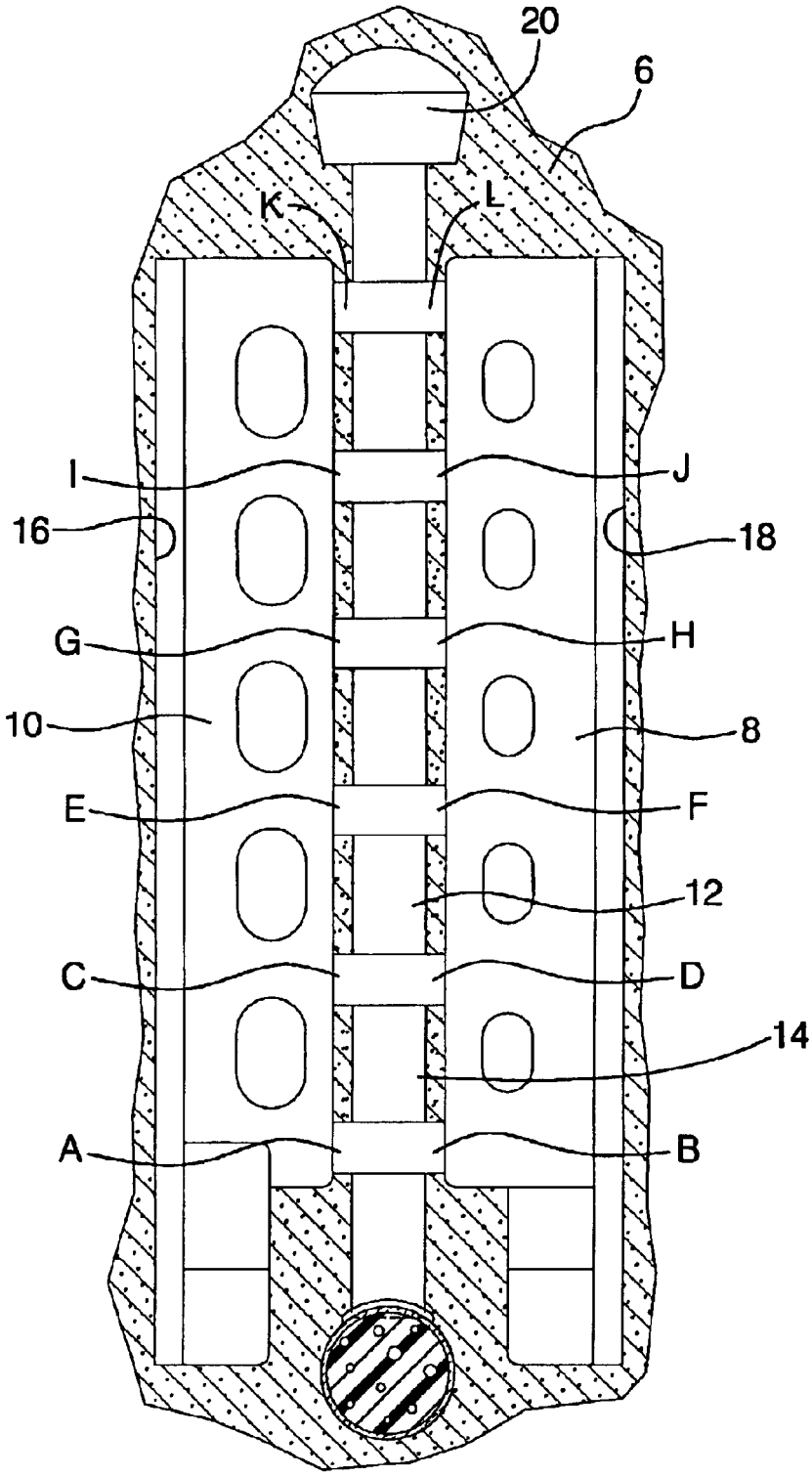
FIG. 2 is a view in the direction 2—2 of FIG. 1.

FIG. 1 depicts a known, lost-foam mold 2 comprising a metal flask 4 filled with loose sand 6 packed around a fugitive, EPS foam pattern 8 that forms a mold cavity 10 in the sand 6. The pattern 8 conforms to the shape of the article being cast, and is coated with a thin, gas-permeable, ceramic layer as is well known in the art. The mold cavity 10 receives and shapes molten metal supplied thereto into a casting, here shown to be the head of an internal combustion engine. While a single head could be cast in a single pouring of melt, in actual commercial practice, several heads are formed at the same time in a single pouring. In this regard and as shown in FIG. 2, it is common practice to attach two or more discrete patterns 8, 10 to a piece of fugitive foam 12 that forms a gating system 14 in the sand 6 that is common to the molding cavities 16, 18 formed by the patterns 10, 8 respectively. The gating system 14 simultaneously dispenses melt to the adjacent mold cavities 16, 18 as the melt progressively rises in the gating system 14 and spills over into each of the mold cavities 16, 18 via a plurality of gates A–L. A fugitive foam crown 20 atop the gating system 14 forms a riser in the sand 6 that receives additional melt and supplies it back to the gating system 14 to make up for shrinkage during cooling/solidification of the melt. If only one article is cast per pour, a simpler gating system may be employed, e.g. one or more gate(s) that admit(s) melt directly into the mold cavity.

Referring again to FIG. 1, molten metal is supplied to the gating system 14 from a hollow sprue 22 which is made from the same pyrolizable foam as the pattern 8, and is likewise coated with a thin gas-permeable ceramic layer 25 like that coating the pattern 8. The sprue 22 has: (1) a mouth 24 at one end for receiving molten metal, (2) a hollow portion 26 extending from the mouth 24 to a level below the pattern 8, and (3) a discharge/outlet end 30 for discharging the molten metal from the sprue. The discharge end 30 engages a piece of solid foam 28 that extends from the discharge end 30 of the sprue 22 to the inlet 32 to the gating system, and has a thin porous ceramic coating 29 thereon. The hollow portion 26 comprises a fugitive foam wall 34 defining an internal flow channel 36. A metal fill cup 38, positioned in the mouth 24 of the sprue 22, receives melt from an overhead ladle or furnace (not shown), and directs it into the flow channel 36. It is also known to use a similar sprue arrangement, but wherein the hollow portion 26 is replaced with solid foam. After pouring and solidification, the metal left in the sprue (i.e. the "sprue-metal") and in the gating system is cut away from the casting, cleaned to remove the ceramic coating left by the sprue, and recycled back to the furnace where it is remelted and reused.

Figure 3:
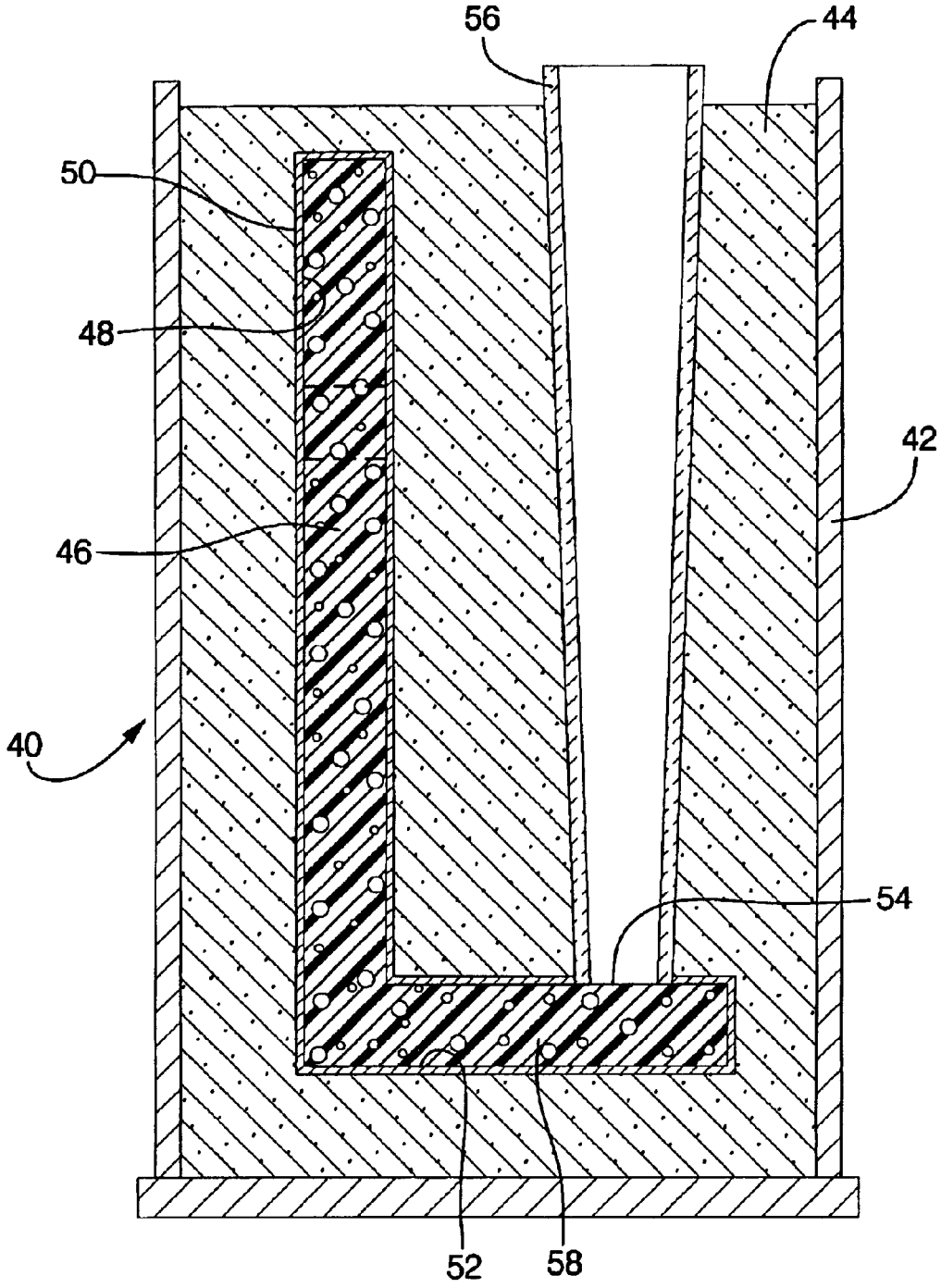
PRIOR ART FIG. 3
FIG. 3 is a sectioned, side view of a sand-filled, lost-foam casting flask having another prior art pattern and sprue arrangement embedded therein.

FIG. 3 depicts another known lost-foam mold and sprue arrangement. A lost-foam mold 40 comprises a metal flask 42 filled with loose sand 44 packed around a fugitive, EPS foam pattern 46 that forms a mold cavity 48 in the sand 44. The pattern 46 is coated with a thin, gas-permeable ceramic layer 50. The mold cavity 48 is filled from the bottom by means of a horizontal runner 52 that connects the bottom of the mold cavity 48 with the outlet 54 of a hollow sprue 56. The runner 52 is formed in the sand 44 by a slab 58 of ceramic-coated pyrolizable EPS foam. The hollow sprue 56 sits atop the slab 58, and comprises a porous, gas-permeable, non-pyrolizable, ceramic shell made, for example, from ceramic fibers commercially available to the lost-foam foundry industry under the trade name ™ PYROTEK CF 300. After pouring and solidification, the metal in the sprue 56 and runner 52 is cut away from the casting, cleaned to remove the ceramic shell and coating thereon, and recycled back to a furnace where it is remelted and reused.

Figure 4:
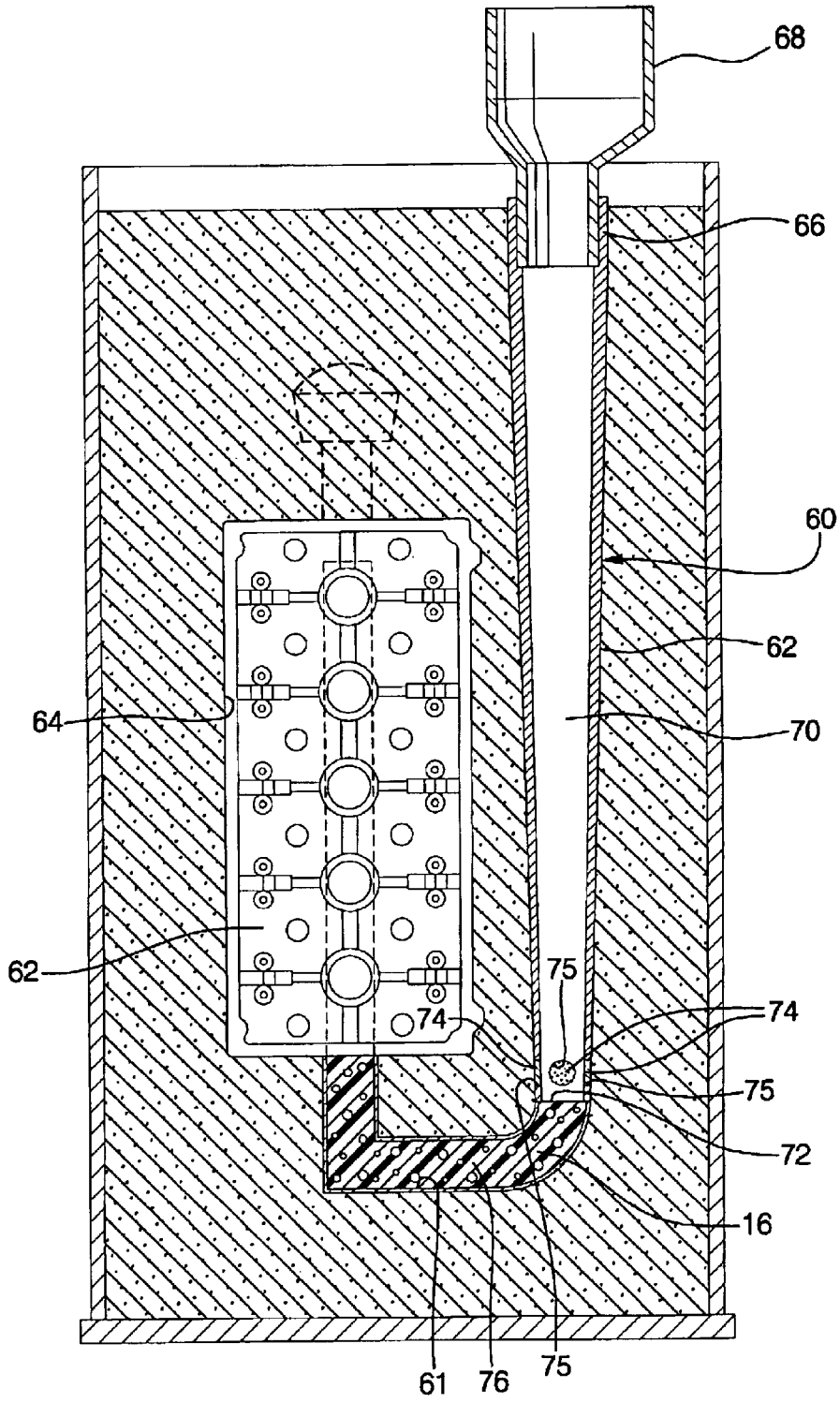
FIG. 4 is a partially-sectioned, side view of a sand-filled, lost-foam casting flask according to one embodiment of the present invention.

FIG. 4 depicts one embodiment of the present invention and is similar to the structure shown in FIG. 1 except for the composition of the sprue 60. In this embodiment, a hollow, sprue 60 consists essentially of the same metal as is being cast (e.g. aluminum). A mouth 66 at the upper end of the sprue 60 holds a pouring cup 68 for receiving molten metal from an overhead ladle or furnace (not shown). An internal flow channel 70 directs the molten metal to beneath the pattern 62, and thence into the gating system that feeds the molten metal into the molding cavity 64 formed by the foam pattern 62 via channel 61 formed in the sand underlying the pattern by the fugitive foam 76. One or more high temperature, porous plugs 74 fill aperture(s) 75 through the metal wall of the sprue 60 adjacent the discharge end 72 thereof where it meets the solid foam 76. Alternatively, high temperature, porous patches (not shown) are affixed (e.g. glued) over the apertures 75 in lieu of use of the plugs 74. In still another variation, a porous sleeve (not shown) may surround the discharge end of the sprue so as to cover the aperture(s). The high temperature porous plug(s)/patches/sleeve may comprise any of a variety of materials that serve to vent air from the sprue that would otherwise be trapped in the sprue 60 during the pouring of the molten metal. By "high-temperature" material is meant a material that will resist melting by, the molten metal being poured until after the air has been expelled from the sprue. Hence, the plug(s) may comprise porous metals, glass or ceramics in such forms as sintered products, screens, fibrous batts, inter alia.

Figure 5:
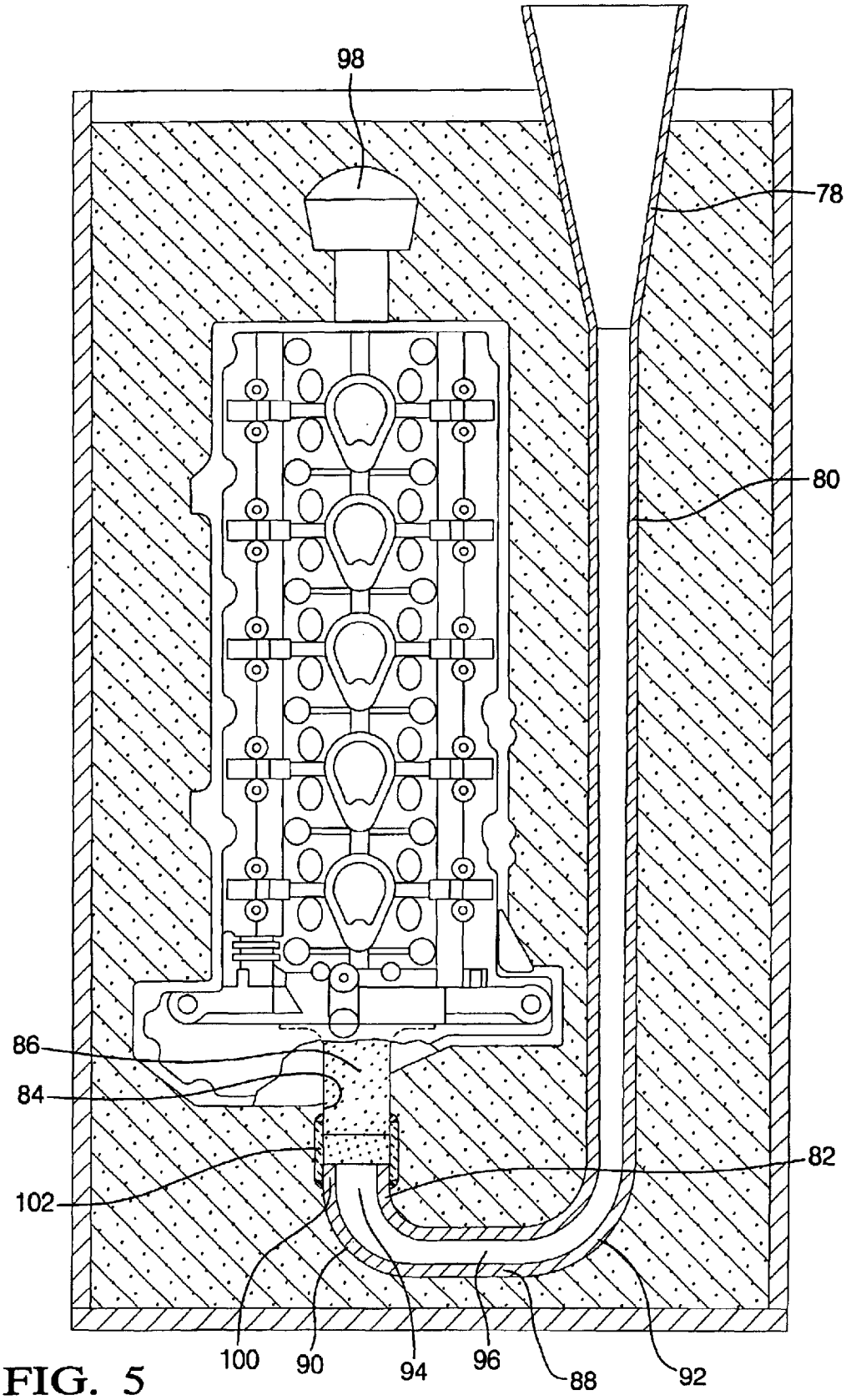
FIG. 5 is a partially-sectioned, side view of a sand-filled, lost-foam casting flask according to another embodiment of the present invention.

FIG. 5 depicts another embodiment of the invention wherein the sprue 78 is generally J-shaped, is foam-free, has a first vertical leg 80 for receiving molten metal from an overhead ladle or furnace, and a second vertical leg 82, shorter than the first leg 80, for directing the flow of molten metal upwardly into the inlet 84 to the gating system which is formed by the fugitive foam projection 86. The second, shorter vertical leg 82 insures that the melt approaches the EPS projection 86 from beneath so as to prevent the pyrolysis gases from flowing into the first vertical leg 80 (see U.S. Ser. No. 10/132,878 supra). The first and second vertical legs are joined by a transition/connector section 88 that is preferably curved at both ends 90 and 92 to provide a smooth, non-turbulent flow in the sprue. The cross-sectional area of the flow channel 94 in the second vertical leg 82 is greater than the cross sectional area of the flow channel 96 in the transition/connector section 88 so as to slow the rate at which the melt front advances upwardly in the second vertical leg 82. A foam crown 98 forms a riser in the sand above the pattern for back-feeding melt into the gating system as the casting cools/solidifies. The outlet end 100 of the sprue 78 is coupled to the projection 86 by means of a porous sleeve-coupling, or collar 102 that serves to vent air from the sprue 78 that would otherwise be trapped in the sprue 78 when molten metal is poured into the sprue. Like the plug(s)/patches of the embodiment shown in FIG. 4, the porous venting collar 102 comprises a high-temperature porous material.

Sprues made in accordance with the present invention will consist essentially of the same metal as is being cast. Hence if aluminum is the metal being cast, the sprue will also be made from aluminum. Preferably, the sprue will comprise the same aluminum alloy as is being cast and will have a wall thickness of about 0.15 mm to about 0.35 mm to insure that the sprue does not melt before pouring is complete. Alternatively, the sprue alloy may comprise the same alloyants as the metal being cast, but in different concentrations adjusted to provide the sprue with a higher melting point than the pouring temperature of the metal being cast which allows the sprue to have thinner walls than would be possible with a lower melting alloy. Other alloyants may be present in the metal that comprises the sprue so long as, after recycling, the presence of such other alloyants will not degrade the properties of the metal being cast. When the composition of the sprue alloy does not exactly match the composition of the casting alloy and the sprue alloy is recycled back to the furnace providing the casting alloy, the composition of the casting alloy in the furnace will periodically be adjusted to keep it within the specifications of required for the casting alloy.

While the invention has been described in terms of certain specific embodiments thereof it is not intended to be limited thereto, but rather only to the extent set forth hereafter in the claims which follow.

What is claimed is:

1. Gravity Lost Foam casting apparatus for shaping an aluminum casting alloy into a desired shape comprising: (1) a bed of loose sand forming a mold having a molding cavity therein conforming to said shape; (2) a flask containing said bed; (3) a fugitive pattern embedded in said bed and shaping said molding cavity, said pattern comprising a polymeric foam pyrolizable by molten said casting alloy poured into said molding cavity; (4) a fugitive body attached to said pattern and forming a gating system in said bed for supplying said molten casting alloy to said molding cavity, (5) an inlet to said gating system for admitting molten casting alloy into said gating system; and (6) a hollow metallic sprue embedded in said bed adjacent said pattern for supplying said molten casting alloy to said inlet, wherein said metallic sprue consists of an aluminum sprue-forming alloy that is recyclable with a melt of such of said casting alloy as solidifies in said sprue following casting to reconstitute said casting alloy for future casting without first having to remove any undesirable ceramic or alloyant materials that might otherwise have been carried into said melt by said sprue.

2. Apparatus according to claim 1 wherein said casting alloy and said sprue-forming alloy contain all the same alloyants.

3. Apparatus according to claim 2 wherein the sprue has a higher melting point than said casting alloy.

4. Apparatus according to claim 1 wherein said sprue has a first end adapted to receive—said molten casting alloy from a supply of said molten casting alloy, a second end remote from said first end discharging said molten casting alloy from said sprue, and a vent adjacent said second end venting air from said sprue away from said cavity and into said sand during pouring of said molten casting alloy.

5. Gravity Lost Foam casting apparatus for shaping molten metal into a desired shape comprising: (1) a bed of loose sand forming a mold having a molding cavity therein conforming to said shape; (2) a flask containing said bed; (3) a fugitive pattern embedded in said sand and shaping said molding cavity, said pattern comprising a polymeric foam pyrolizable by said molten metal poured into said molding cavity; (4) a fugitive body attached to said pattern and forming a gating system in said sand for supplying said molten metal to said molding cavity, (5) an inlet to said gating system for admitting molten metal into said gating system; and (6) a hollow metallic sprue embedded in said sand adjacent said pattern for supplying said molten metal to said inlet, wherein said metallic sprue (a) consists essentially of the same composition as said metal so as to be recyclable with a melt of such of said metal as is retained by said sprue without first having to remove any ceramic materials that might be carried into said melt by said sprue, and (b) has a first end adapted to receive said molten metal from a supply of said molten metal, a second end remote from said first end discharging said molten metal from said sprue, and a vent adjacent said second end venting air from said sprue away from said cavity and into said sand during pouring of said molten metal.

6. Apparatus according to claim 5 wherein said vent comprises at least one aperture in a wall of said sprue, and a high temperature, porous plug filling said aperture.

7. Apparatus according to claim 5 wherein said vent comprises a high temperature, porous sleeve-coupling joining said second end to said inlet.

8. Apparatus according to claim 6 wherein said porous plug comprises a ceramic.

9. Apparatus according to claim 7 wherein said porous sleeve-coupling comprises a ceramic.

10. Apparatus according to claim 5 wherein said vent comprises one or more aperture(s) in a wall of said sprue, and a high temperature, porous patch covering said aperture (s).

11. Apparatus according to claim 5 wherein said vent comprises one or more aperture(s) in a wall of said sprue, and a high temperature, porous sleeve covering said aperture (s).

* * * * *